US006626195B1

(12) United States Patent
Garman et al.

(10) Patent No.: US 6,626,195 B1
(45) Date of Patent: Sep. 30, 2003

(54) HIGH PRESSURE TUBE CLEANING APPARATUS

(75) Inventors: Daniel T. Garman, Eveleth, MN (US); Eugene R. Valentine, New Philadelphia, OH (US)

(73) Assignee: Aqua Dynamics, Inc., Eveleth, MN (US)

( * ) Notice: Subject to any disclaimer, the term of this patent is extended or adjusted under 35 U.S.C. 154(b) by 70 days.

(21) Appl. No.: 09/811,064

(22) Filed: Mar. 16, 2001

(51) Int. Cl.[7] ..... B08B 9/045; B08B 9/047
(52) U.S. Cl. ..... 134/104.1; 134/167 C
(58) Field of Search ..... 134/167 C, 168 C, 134/104.1; 15/104.33

(56) References Cited

U.S. PATENT DOCUMENTS

| | | | | |
|---|---|---|---|---|
| 3,077,314 A | * | 2/1963 | Caperton | 15/104.33 X |
| 3,370,599 A | * | 2/1968 | Ciaccio | 134/167 C |
| 3,399,415 A | * | 9/1968 | Hammond et al. | 14/104.33 |
| 5,031,263 A | * | 7/1991 | Babb et al. | 15/104.33 |
| 5,193,242 A | * | 3/1993 | Irwin | 15/104.33 |
| 5,579,726 A | | 12/1996 | Finucane | |
| 5,996,159 A | * | 12/1999 | Irwin | 134/168 C |

OTHER PUBLICATIONS

Gardner Denver Operator's Manual—100,000 PSI "V" Drum (Rotary Line Cleaner), 16 Pages.
Jetting Systems, Inc. —Flex Lancer, Advertisement, 1Page.
Jetting Systems, Inc.—Rotary Flex Lancer, Advertisement, 1Page.

* cited by examiner

*Primary Examiner*—Philip Coe
(74) *Attorney, Agent, or Firm*—D L Tschida

(57) ABSTRACT

An assembly for rotating and axially directing a high pressure spray hose and spray head to clean residue from the bores of thermal transfer tubes. The assembly includes a number of subassemblies that are concentrically aligned and mounted to rotate in synchrony and direct a high-pressure hose and spray head. A hose cleaning subassembly washes and/or brushes the hose exterior with a low-pressure spray. A hose drive assembly controls axial hose movement via driven gears and chains and four polyurethane pinch wheels that abut the hose. Spring tensioners control the wheel-to-hose pressure. A layering arm extends from a driven reel axle and stacks the hose in uniform layer onto an adjustable hub at a driven reel. The diameter of the reel hub can adjusted relative to an outer cage. The hose reel, axial hose drive and hose cleaner assemblies can be operated at speeds rotational speeds of 60 rpm to 650 rpm and whereby tubes from ½ to 6-inch diameters can be cleaned at rates of 1 to 80 feet per minute.

20 Claims, 6 Drawing Sheets

HIGH PRESSURE TUBE CLEANING APPARATUS

BACKGROUND OF THE INVENTION

The present invention relates to cleaning equipment for tubes and piping and, in particular, to high-pressure water spray systems for cleaning the bores of tubes mounted in a variety of equipment, such as heat exchangers, falling pressure evaporators and the like.

Industrial piping systems of all types frequently require cleaning. A problem especially common to heat exchangers and evaporators is that over time the bore and exterior walls of the heat exchange tubes develop corrosion, scale and other undesired residue. The buildup of residue decreases and/or generally adversely effects the heat transfer efficiencies. Operating costs for fuel, in turn, increase.

Periodic maintenance is thus required to clean the tubes. Frequently the equipment must be taken off-line during maintenance. Such maintenance can be performed by plant personnel or outside contractors who are specially trained and use special purpose equipment to perform such tasks. It is desirable that any down time be minimized. The task is typically performed manually and is therefore costly and time consuming, especially for large heating and cooling plants.

A variety of techniques and types of equipment have been developed to clean the interior and exterior surfaces of pipes and particularly heat transfer tubes. Soot blowing and chemical shocking are two techniques. Another technique is to individually direct equipment into each tube to mechanically dislodge the residue from the tube walls. Some of the latter equipment uses rigid lances that either rotate and/or have rotating blades. U.S. Pat. No. 5,579,726 discloses a lance-based assembly that directs streams of high-pressure water to effect the cleaning. The latter system supports a rotating and axially directed lance from a frame that can be aligned to each tube.

High-pressure spray systems are also known that direct streams of water from a spray hose into each tube. Jetting Systems & Accessories, Inc. sells one such system under the brand name "FLEX LANCER". Another system is sold by Gardner Denver Water Jetting Systems, Inc., Houston, Tex. under the name "V" Drum Rotary Line Cleaner. The latter system provides a high-pressure hose and spray nozzle that are rotated and axially directed under power. Hose movement is directed with a hand-operated air controller and a pinch roller assembly that controls axial hose movement. Rotational movement is controlled via a separate motor. The hose is collected and dispensed from a rotating V-shaped spool or drum. Although offering advantages, the efficiency of the latter system is severely restricted by vibrations that occur due to unbalanced conditions that can occur at the equipment during typical use. Extreme vibrations have particularly been experienced at speeds approaching 60 rpm, which severely limits the utility of the equipment.

The present invention was developed to provide a more efficient high-pressure spray system. The assembly provides a hose mounted spray head that can be operated at rotational speeds in the range of 60 rpm to 850 rpm. Axial speeds in the ranges of 1 foot per minute to 80 feet per minute are also possible. At a nominal rotary speed of 300 rpm and an axial speed of 60 feet per minute the assembly is able to clean a typical 36-foot tube in one-fourth the time as the foregoing equipment.

The assembly is constructed to provide optimal balance along the entire drive train. The assembly also cleans the exterior surface of the spray hose as it is dispensed and collected from a driven spool or reel assembly. The reel assembly stacks the hosing in a tapered coil that is balanced to the longitudinal drive axis of the hose drive train. The hub of the reel assembly can be adjusted to accommodate different lengths and diameters of hose.

SUMMARY OF THE INVENTION

It is accordingly a primary object of the invention to provide a high-pressure tube cleaning assembly wherein a spray hose and spray nozzle can be directed at high rotational and axial rates by the assembly as the nozzle is directed through each tube being cleaned.

It is a further object of the invention to provide an assembly that includes a rotationally driven hose reel that arranges the spray hose in a fashion that avoids unbalancing the equipment relative to a longitudinal, rotational drive axis.

It is a further object of the invention to provide a hose reel having a conically tapered, hose collection hub mounted adjacent to a concentric outer cage and on which hub the hose is stacked in coils concentrically aligned to the longitudinal drive axis.

It is a further object of the invention to provide a hose cleaning assembly that cleans the hose as it is dispensed and collected.

It is a further object of the invention to provide a rotary mounted, air-controlled hose drive assembly having four polyurethane pinch-type drive wheels that axially direct the hose along the assembly's longitudinal drive axis and that is rotationally balanced relative to a hose reel.

It is a further object of the invention to provide a drive axle at the hose reel that is coupled to the hose drive assembly and from which axle a layering arm extends that aligns the hose relative to an adjustable hub at the hose reel.

It is a further object of the invention to provide a hose collection hub wherein the diameter and taper of the hose collection hub can be adjusted relative to the outer cage and center drive axle.

The foregoing objects, advantages and distinctions of the invention, among others, are obtained in the following disclosed tube cleaning assembly that has been particularly adapted for use in cleaning heat exchangers and falling tube evaporators. The invention can be adapted to other applications wherein the tool head is coupled to a high-speed, rotationally and axially directed supply conduit.

The subject tube cleaning assembly provides a mobile framework that attaches to on-site air and water supplies. The assembly includes a number of subassemblies that are concentrically aligned along a longitudinal drive axis to direct a high-pressure hose and spray head. The subassemblies are mounted to rotate in controlled synchrony at a number of pillow block bearings.

At a fore end, the hose and orifice containing spray head are directed through a hose cleaning subassembly that washes the hose with a low-pressure spray. The hose is axially directed to and fro with an air-controlled hose drive assembly. A hand-operated valve directs air to an air swivel and a pair of drive motors. Drive power is applied to a pair of driven gears and chains to follower gears attached to four polyurethane pinch wheels that abut the hose. Spring tensioners control the wheel-to-hose pressure and are able to axially direct the hose at speeds of 1 to 80 feet per minute.

The hose drive is coupled to a hose collection reel via a motor driven reel axle. A layering arm extends from the axle and directs the hose onto an adjustable hub at the reel. The hose is preferably stacked in a single layer. A swivel at the opposite end of the reel axle supplies high-pressure water in the range of 3,000 psi to 50,000 psi to the hose.

The diameter of the hub at the hose reel can adjusted relative to an outer cage. The layering arm and hub cooperate to stack the hose in concentric layers relative to the longitudinal drive axis of the assembly to assure a balanced loading. The reel, axial hose drive and hose cleaner assemblies can be operated at rotational speeds in the range of 60 rpm to 650 rpm. The assembly is thereby able to clean tubes from ½ to 6-inch diameters at rates of 1 to 80 feet per minute.

Still other objects, advantages, distinctions and constructions of the invention will become more apparent from the following description with respect to the appended drawings. Similar components and assemblies are referred to in the various drawings with similar alphanumeric reference characters. Various features of the invention may also be configured with other features in different combinations. The description should therefore not be literally construed in limitation of the invention. Rather, the invention should be interpreted within the broad scope of the further appended claims.

DESCRIPTION OF THE PREFERRED EMBODIMENT

Figure 1:
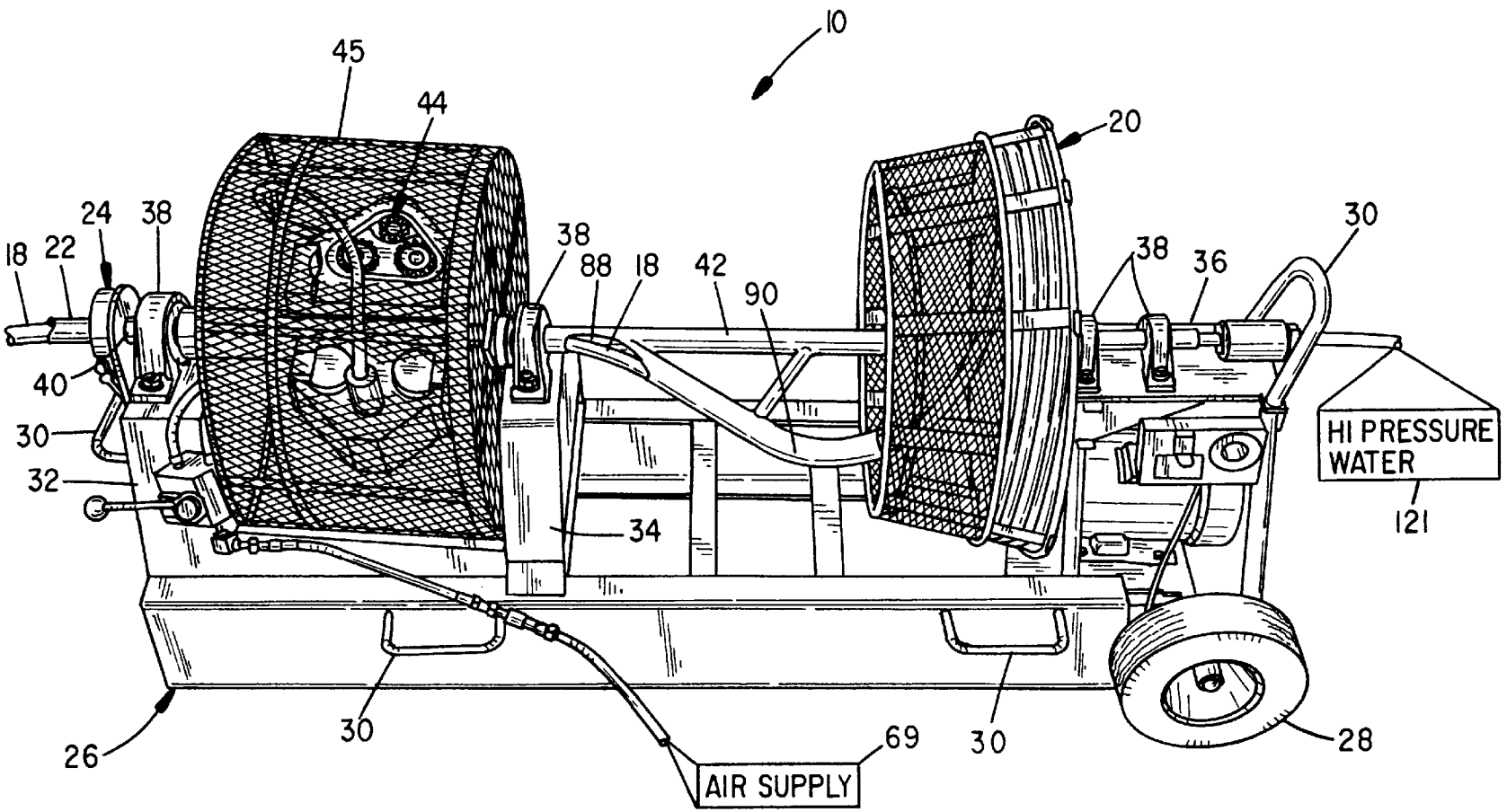
FIG. 1 is a perspective drawing shown in partial cutaway and exposing the various subassemblies of the high-pressure spray cleaning equipment of the invention.

Referring to FIG. 1 a perspective drawing is shown to the portable, high-pressure spray cleaning assembly 10 of the invention. The assembly 10 finds particular application for on-site cleaning of heat transfer tubes in commercial and industrial heat exchangers. A spray head 12 having a desired number of orifices 14, reference FIG. 2, directs a number of high-pressure (e.g. 200 to 50,000 psi) streams of water against the bore walls of a heat transfer tube or pipe 16 to dislodge and wash scale and residue from the tube walls 16. The spray head 12 is rotated and axially extended and retracted from the tube 16 to most advantageously direct the spray streams from the orifices 14.

A suitable length of hose 18 is secured to the spray head 12 and is deployed and stored at a hose spool or collection reel assembly 20. The hose 18 is constructed to withstand the normal anticipated working conditions and pressures. The hose 18 is typically constructed of several layers of water impermeable material in numerous wound wrappings and may contain wraps or bands of wire, KEVLAR and the like. The diameter of the hose 18 can be adjusted as desired (e.g. ⅛ to 1 inch) depending upon the application, diameter of tube 18 and desired working pressures.

The hose 18 is contained in a length of a flexible, tubular cover piece 22 that is secured to a hose washing assembly 24. The hose 18 is free to slide and rotate within the cover piece 22. The cover piece 22 particularly protects the hose 18 as an operator directs the assembly and hose 18 about the work site and as the hose 18 is manipulated by the operator and fitted to each tube 16 being cleaned.

A support frame 26 provides a number of wheels 28 and handles 30 that make the assembly 10 portable. Several stanchions 32, 34 and 36 rise from the frame 26 to support a number of pillow block bearings 38. A forward, hollow stub axle 40 and a partially hollow drive axle 42 are contained by the bearings 38 and permit rotation of a coupled axial hose drive assembly 44 and the hose reel 20. The horizontal spacing between and vertical offset of the stanchions 32–36 can be adjusted depending upon the size and length of hose 18 that is being deployed.

Figure 2:
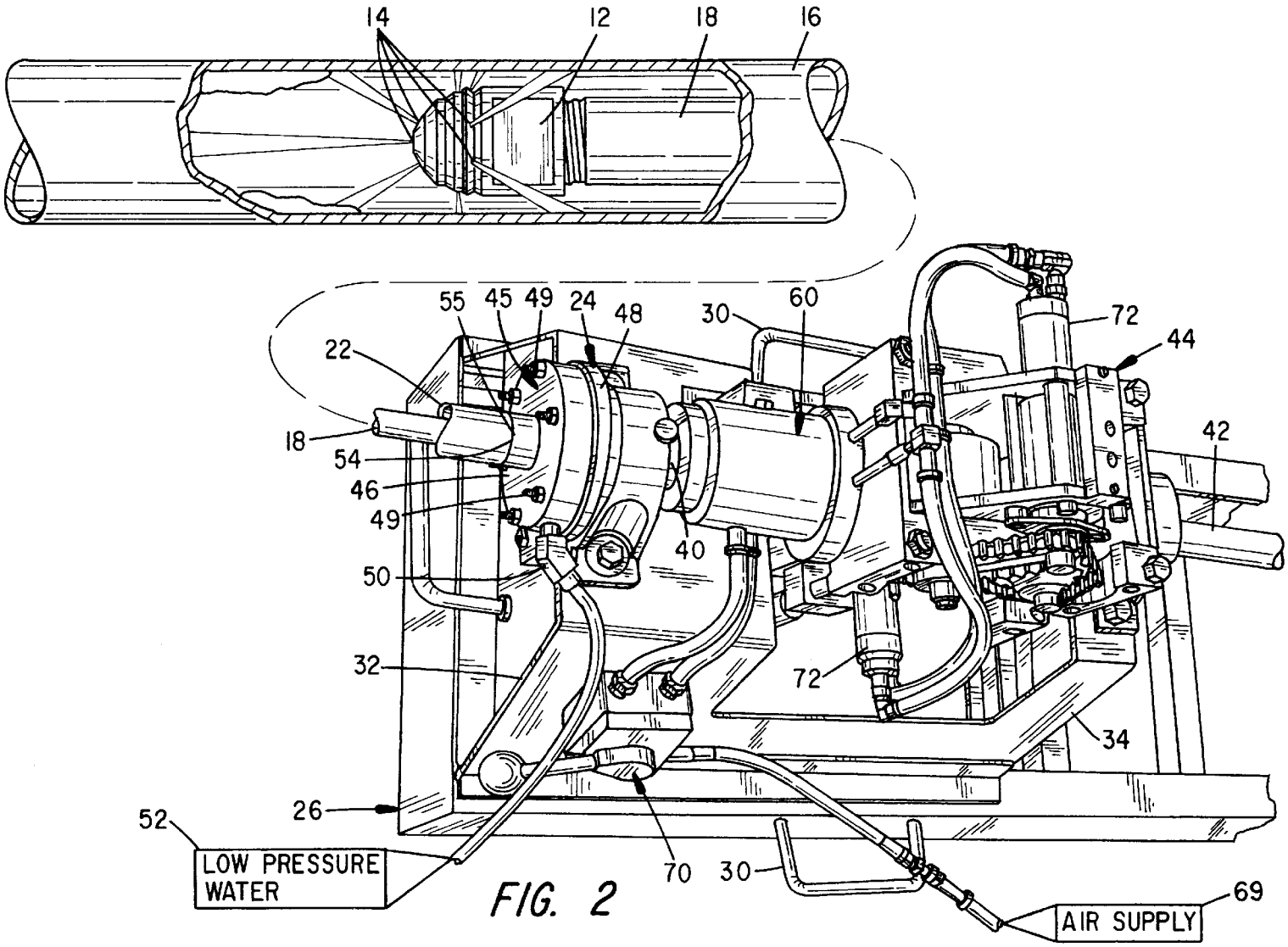
FIG. 2 is a detailed perspective view to the hose cleaner and air-driven hose drive and wherein the spray head is also shown in cutaway in a typical heat exchanger tube.

With attention to FIG. 2, the hose cleaning assembly 24 extends forward of the stanchion 32 from the stub axle 40. The hose cleaning assembly 24 essentially comprises a manifold 45 having bolted cylindrical sections head and backing pieces 46 and 48 that directs several low-pressure streams of water onto the outer walls of the hose 18. A number of flow channels (not shown) are formed into head and backing pieces 46 and 48 that are secured with several fasteners 49. A fitting 50 couples a water supply line 52 to the manifold 45. The water is directed from a central bore 54 through which the hose 18 passes. One or more brushes 55 can be secured and concentrically aligned to the headpiece 46 and the hose 18 to scrub debris during hose cleaning.

The hose 18 is directed axially through the cleaning assembly 24 by the hose transport or drive assembly 44. The hose drive assembly 44 is mounted to rotate between the stanchions 32 and 34 and is covered by a safety cage 45. The hose reel 20 is mounted to rotate between the stanchions 34 and 36. Each of the assemblies 20, 24 and 44 are concentrically aligned to the center longitudinal drive axis of the assembly 10 and relative to which the hose 18 is particularly coaxially and concentrically aligned. Hose movement is thus balanced to the drive axis and the enhanced operating speeds are possible.

Figure 3:
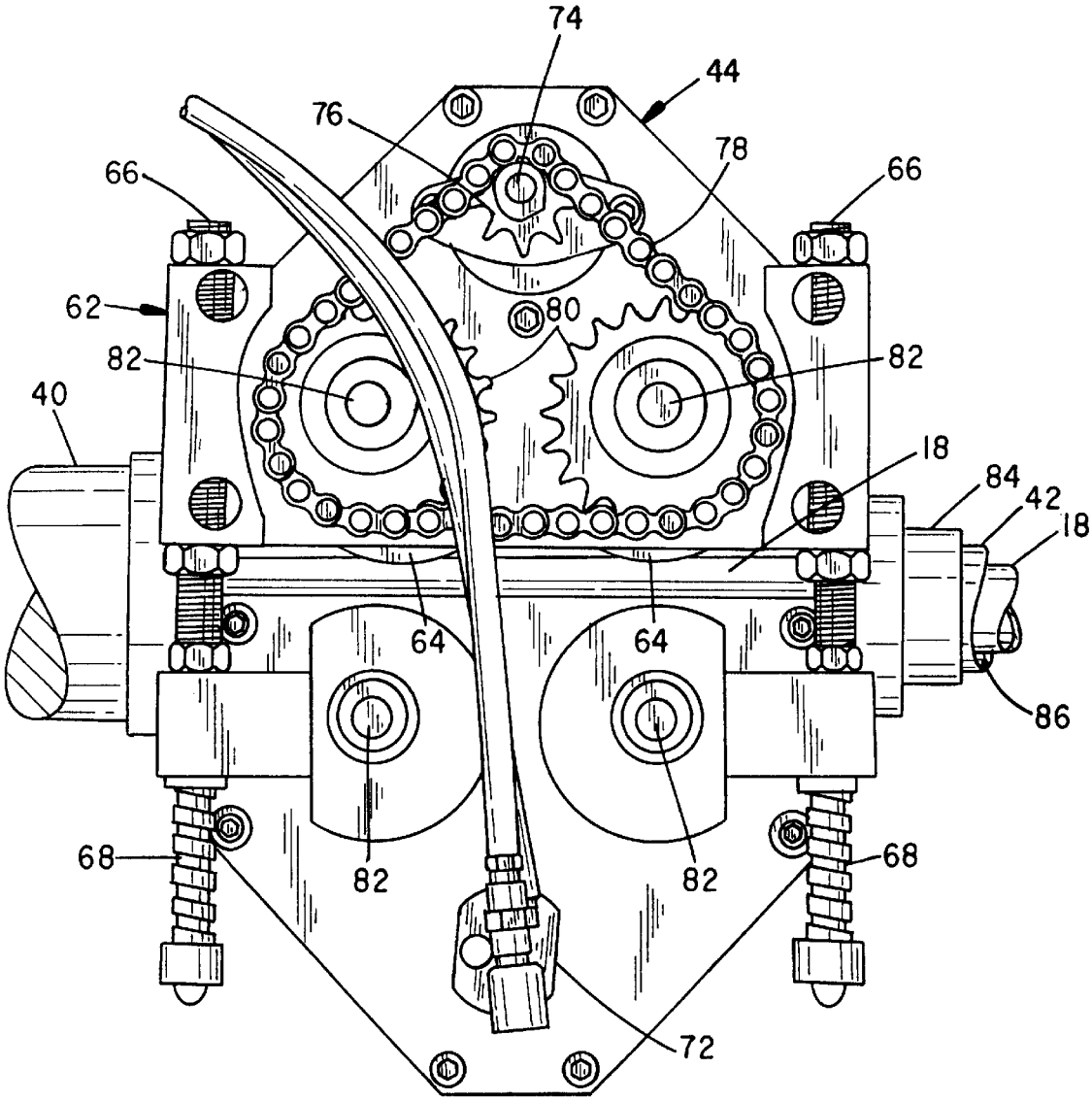
FIG. 3 is an enlarged plan view of the hose drive assembly

With attention to FIGS. 2 and 3, an air swivel 60 is secured to the forward end of a two-section, split drive frame 62 of the drive assembly 44. The frame assembly 62 supports four polyurethane pinch-wheels 64 that grip the hose 18. Adjusting bolts 66 and springs 68 control the tension or pinch pressure of the wheels 64 against the hose 18. Two pairs of the pinch-wheels 64 (only two of which are shown) are arranged 1800 opposite each other to overly each other. The wheels 64 can also be positioned in other arrangements. The wheel material can also be varied as desired relative to the hose 18 to provide optimal friction and wear tolerance between the wheels 64 and hose 18.

A hand-operated valve 70 controls airflow from an air supply 69 through the swivel 60 and to a pair of air driven motors 72 secured to the frame 62. A drive axle 74 of each motor 72 is coupled to a drive gear 76. Power is directed via a chain 78 to a pair of follower gears 80 that are coupled to axles 82 that are secured to each drive wheel 64. The valve 70 is controlled to bi-directionally direct the hose 18 with a reciprocating motion at a desired axial speed to achieve proper tube cleaning, hose deployment and collection. A coupler 84 at the aft end of the frame 62 secures the frame 62 to the drive axle 42. Although an air powered transport drive is presently used, hydraulic, electric or other types of power drives can be adapted to the assembly 44.

The rate of movement of the hose 18 through the hose drive assembly 44 is regulated in relation to the rotational speed of the reel 20 to assure that the hose 18 is synchronously extracted and stacked to avoid kinking, strain or slack at the reel 20. The relative speeds also take into account the operating rigidity of the hose 18, which is relatively stiff when placed under the pressures discussed herein. Any of the latter conditions can unbalance the assembly 10. During a cleaning stroke, when the hose 18 is extended into a tube 16, the assembly 44 and reel 20 rotate at a slower speed. During hose retraction from the cleaned tube 16, when there is relatively little resistance to motion, the assembly 44 and reel 20 are rotated faster. The operator via the valve 70 manually controls the relative rates of rotation.

The relative rates are established empirically as required to meet the working conditions by regulating the air pressure at the valve 70 in relation to the constant drive power provided to the reel 20. An electric motor and V-belt/pulley transmission determine the rotational speed of the reel 20 which are discussed in more detail below. A variety of automatic control assemblies can also be adapted to the assembly 10 to obtain automatic speed regulation, such as by monitoring the condition of the hose 18 at the reel 20 via appropriate sensors. Sensor feedback can be directed to the speed regulators at the assembly 44 and reel 20.

For jobs requiring multiple assemblies 10, cleaning time can be reduced and equipment operation improved by coupling the several assemblies 10 to the single air supply 69 and operating the assemblies 10 in complementary fashion. That is, as the hose 18 of one assembly 10 is directed in a cleaning stroke, the hose 18 of another assembly 10 is collected. The demand on the air supply is therefore substantially continuous.

Figure 4:
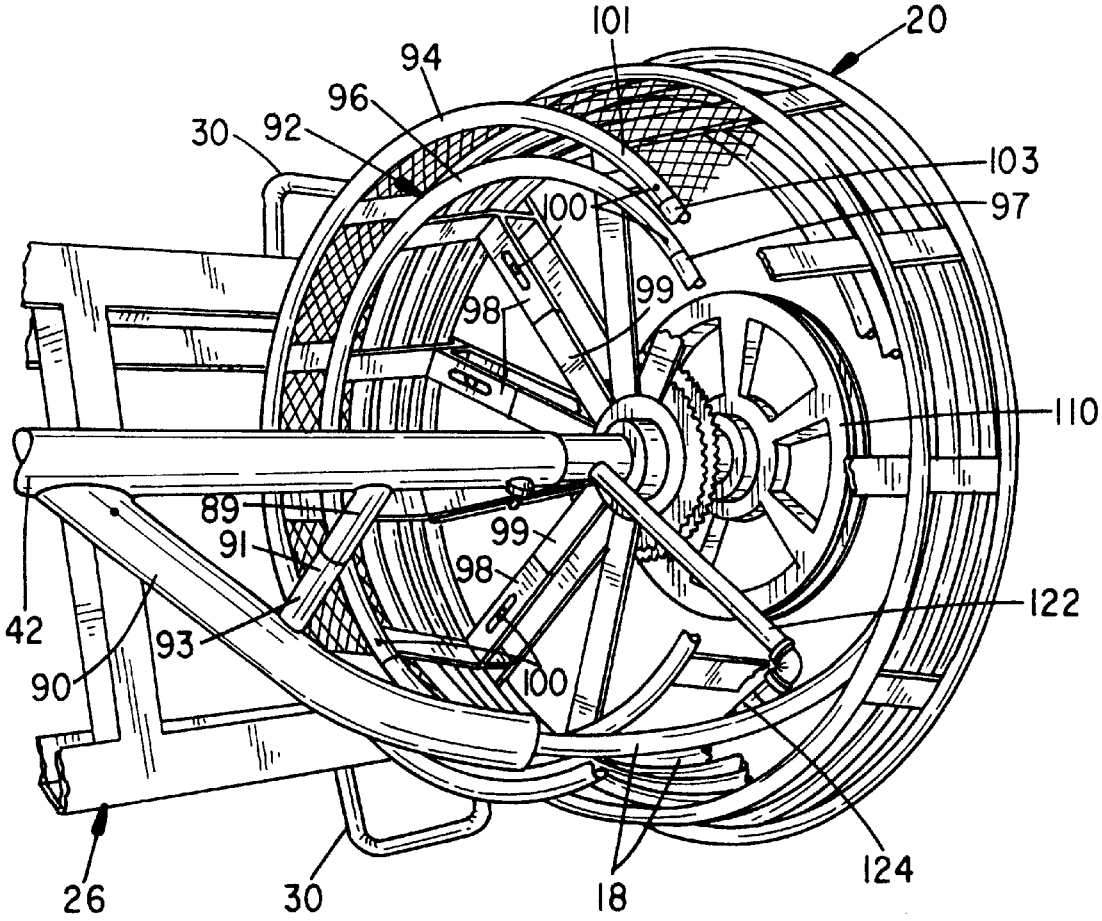
FIG. 4 is a perspective view to the hose collection reel with a length of spray hose arranged on the hub and also showing length adjustable link arms and end hoops of the hub.

With attention to FIG. 4, the hose 18 passes through a bore 86 at the forward end of the drive axle 42 and a bore 88 of a layering arm 90 that extends from the side of the axle 42. The layering arm 90 directs the hose 18 onto a center hub 92 of the reel 20. The hub 92 is concentrically positioned relative to an outer cage 94 such that the hose 18 is deposited in a single, layered coil that is concentric to the drive axis of the assembly 10. The changing weight of the hose 18 and contained liquid is thus dynamically balanced to the assembly 10. The reel assembly 20 can also be constructed to provide for multiple side-by-side coil wraps. For example, the diameter of the hub 92 may be constructed to expand and contract dynamically via centrifugal force and/or automatically with a controlled linkage. The arm 90 can also be mounted to pivot relative to the hub 92 to control layering. In the latter regard, the arm 90 can be hinged to pivot at the axle 42 and the linkage arm 93 can be constructed in two telescoping sections 89, 91.

FIG. 4 also depicts adjustment features of the reel assembly 20. That is, the fore and aft diameters of the hub 92 can be adjusted at the interconnected, telescoping hoop pieces 96, 97 and length adjustable spoke pieces 98, 99. Proper adjustment of the hub 92 can be arranged to be cylindrical or provide a taper. The hub 92 is presently constructed to taper inward as it extends forward and accommodates a single, stacked coil of hose 18.

The hoops 96, 97 and spoke pieces 98, 99 are adjusted in concert with a number of fasteners 100. Slots 102 in the spoke pieces 98, 99 overlap the fasteners 100. The outer cage 94 can also be constructed with adjustable hoops 101, 103 and spoke pieces 104, 105 relative to slots 102 and fasteners 100 as shown by representative example at FIGS. 4 and 5. Still other adjustable arrangements at the layering arm 90 and hub 92 can be provided to balance multiple coils, yet maintain a concentric assembly.

Figure 5:
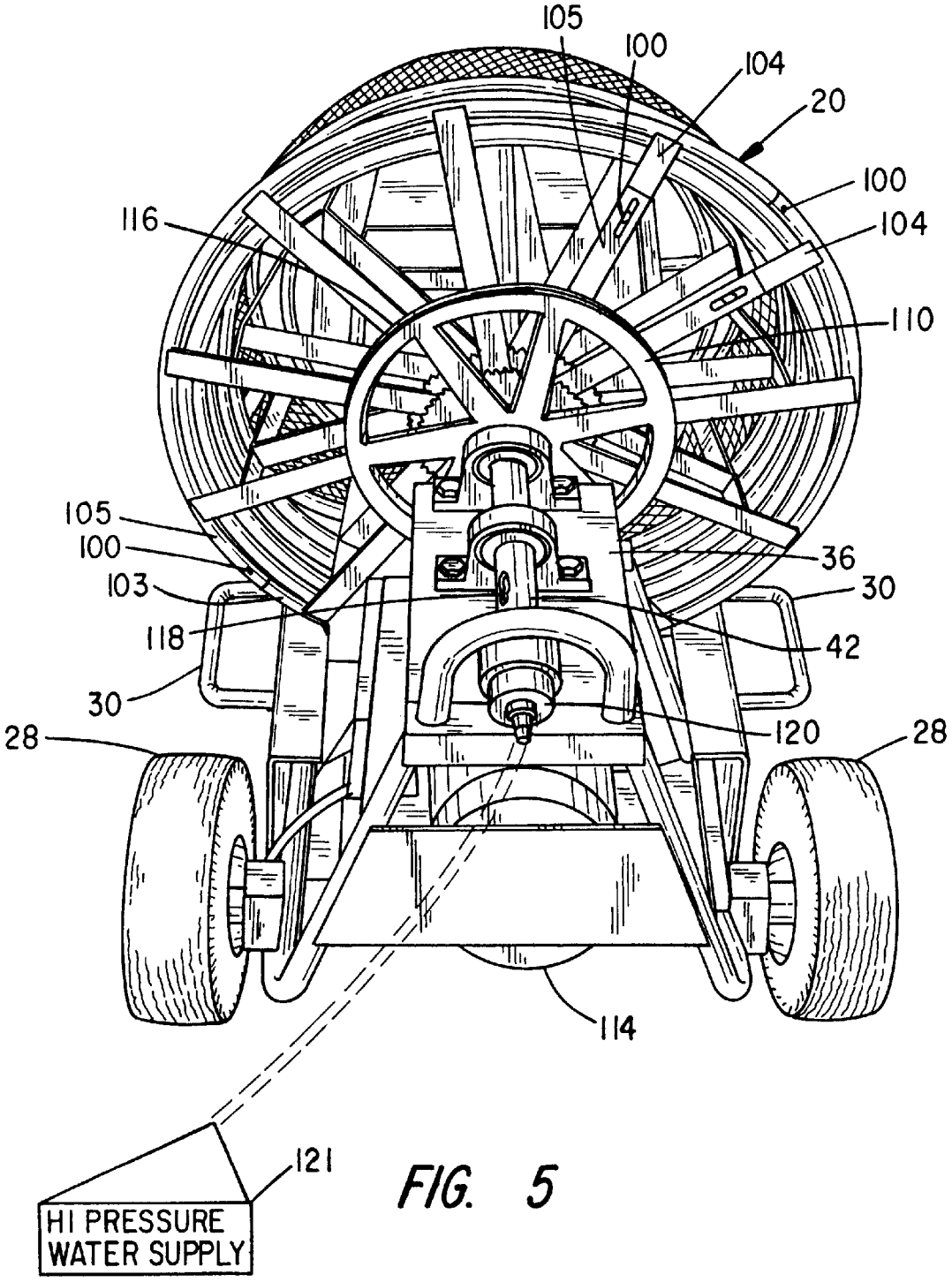
FIG. 5 is a perspective view to the aft end of the hose reel showing the adjustable link arms and end hoops of the outer cage.

FIG. 5 depicts a drive pulley 110 that is secured to the aft end of drive axle 42. Rotational drive power is supplied to the axle 42 from another pulley attached to via a drive motor 114 and belt 116. The rotational speed can be varied as desired by adjusting the relative diameters of the motor pulley to the drive pulley 110. The assembly 10 has been operated at speeds in excess of 400 rpm and approaching 650 rpm without experiencing vibration. This is in contrast to maximum operating speeds of 60 rpm for competitive assemblies.

A bore 118 at the aft end of the drive axle 42 is coupled to a swivel 120 and a high-pressure water source 121. Water is directed through the swivel 120, axle 42, a stub pipe 122 and coupler 124 to the hose 18. The working spray pressures can be varied as desired. Presently, pressures in the range of 4,000 psi to 36,000 psi are preferred when cleaning tubes found in boilers and evaporators.

Figure 6:
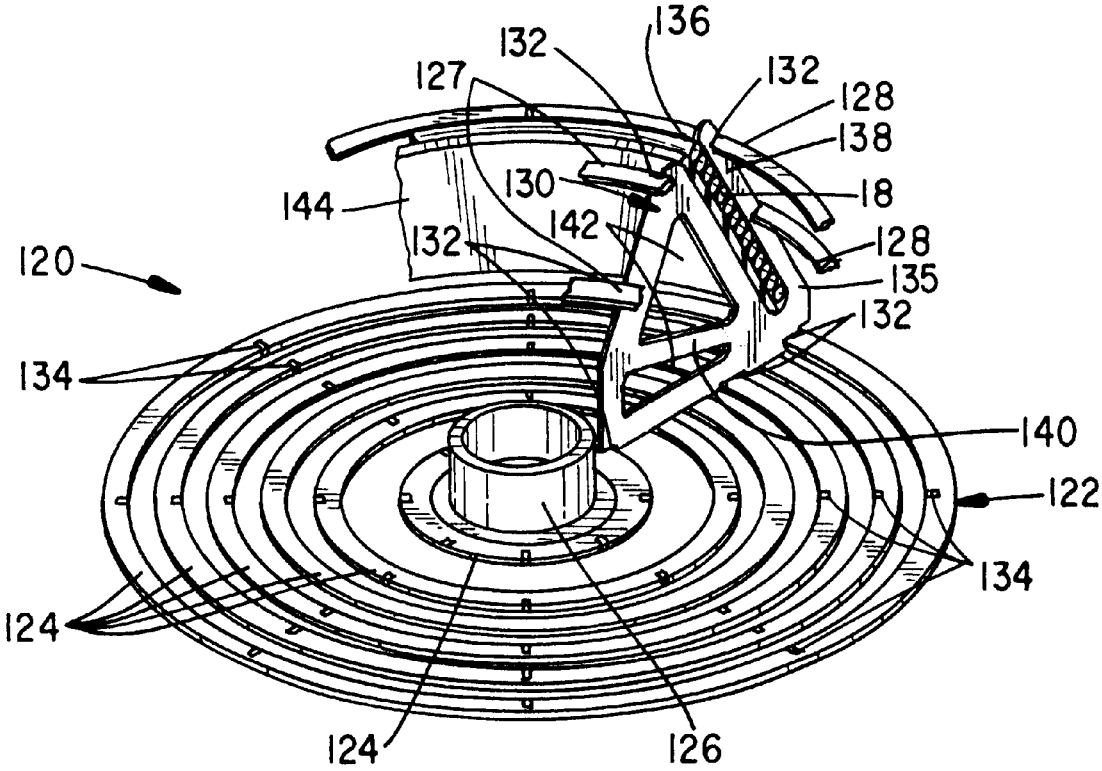
FIG. 6 is a perspective view shown in partial section to an alternative hose collection reel having an outer cage and to which a number of removable upright strut plates are attached to accommodate differing hose lengths and diameters.

FIG. 6 discloses an alternative reel assembly 120 that can be adjusted with relative ease to accommodate hoses 16 of different diameter and length. The reel assembly 120 provides a base 122 that is defined by a number of annular bands 124 and a center collar piece 126 that mounts to the axle 42. A number of inner and outer cage bands 127 and 128 are vertically offset from the base 122. The base and cage bands 124, 126 and 128 are coupled (e.g. welded) to a number of upright, planar strut plates 130 at notches 132 let into the peripheral edges of the plates 130.

Only one strut plate 130 is shown, but it is to be appreciated that several other identical plates 130 are mounted to align with notches 134 at each of the bands 124 and mate with the bands 124, 127 and 128. The assembly 120 provides for eight plates 130, but the number of plates 130 can be varied as desired.

A hose collection channel 136 is defined at each plate 130 between an outer arm 135 and inner hub 140. A number of coils of the hose 18 are shown as they appear when layered in the channel 136. The channels 136 project at an acute angle relative to the base 122 as they extend inward toward the collar 126 to define a tapered hose storage space.

The assembly 120 can be constructed of a variety of materials, although aluminum is presently preferred to reduce weight. Weight relief holes 142 are also provided in the plates 130.

The channel 136 is constructed oversized to nominally accommodate hoses from ¼ to 2-inch diameters. When a smaller diameter hose 18 is being used, a frustum shaped spacer 144 is also mounted in the channel to take-up space and assure the hose is layered in uniform coils.

The strut plates 130 thus define several vertical ribs that collectively capture and contain the hose 18 in relation to the layering arm 90. The reel assembly 120 can be adapted to accommodate hoses 16 of different diameter and length upon attaching an appropriate spacer 144.

While the invention has been described with respect to several assemblies and considered improvements or alternatives thereto, still other constructions may be suggested to those skilled in the art. For example, the hose washing assembly 24, axial drive assembly 40 and/or adjustable reel assembly 20 can be used in combination or can be provided in other cleaning system arrangements. The cleaning equipment can include other controls for adjusting the rotational and axial operating speeds. Sundry safety controls can also be provided. The foregoing description should therefore not be literally construed and should instead be construed to include all those embodiments within the spirit and scope of the following claims.

What is claimed is:

1. Apparatus for cleaning residue, comprising:

a) a hose having a spray tip containing a plurality of orifices;

b) a water source coupled to said hose capable of delivering water to said hose at a pressure in excess of 1,000 psi; and c) a framework supporting i) transport means for extending and retracting said hose with a reciprocating motion, ii) reel means for collecting and distributing said hose along a longitudinal drive axis common to each of said transport and reel means and including means for stacking said hose into coils aligned one on top of the other and concentric to said drive axis and iii) means for simultaneously rotating said transport means and said reel means, whereby said hose and spray tip are rotated as they extend and retract along a bore of said tube to clean said residue.

2. Apparatus as set forth in claim 1 wherein said reel means includes a hollow arm that extends from said longitudinal axis and though which arm said hose extends and is directed to and from a hub mounted concentric to said longitudinal drive axis.

3. Apparatus as set forth in claim 2 wherein said hose is collected at a tapered surface of said hub that extends at an acute angle relative to the longitudinal drive axis.

4. Apparatus as set forth in claim 2 wherein said hub exhibits a frustum shape and is concentrically mounted within a surrounding housing.

5. Apparatus as set forth in claim 2 wherein said reel means includes a plurality of members mounted in length adjustable relation to each other to vary the diameter of said hub.

6. Apparatus as set forth in claim 2 wherein said transport means includes a plurality of pinch rollers mounted to contact said hose and control means for directing the reciprocating axial movement of said hose in synchrony with the rotational movement of said hose.

7. Apparatus as set forth in claim 6 wherein said pinch rollers are driven by air operated motors and a chain linkage and said control means comprises an air valve.

8. Apparatus as set forth in claim 2 wherein said arm is mounted to pivot relative to said hub such that said hose can be directed onto said hub in a plurality of stacked adjacent coils.

9. Apparatus as set forth in claim 2 wherein said reel means includes a plurality of planar members mounted to a plurality annular bands, wherein a tapered channel extends in each planar member at an acute angle relative to the longitudinal drive axis and wherein said hose is directed into and from said channel.

10. Apparatus as set forth in claim 1 including cleaning means mounted concentric to said longitudinal drive axis for cleaning the external surface of said hose.

11. Apparatus as set forth in claim 10 including a brush mounted concentric to said longitudinal drive axis for cleaning the external surface of said hose.

12. Apparatus as set forth in claim 10 including a manifold mounted concentric to said longitudinal drive axis and coupled to a water source and having a plurality of outlets for directing spray to cleaning the external surface of said hose.

13. Apparatus as set forth in claim 1 wherein a motor, drive belt and a plurality of pulleys determine the speed of rotation of said reel means.

14. Apparatus for cleaning residu , comprising:

a) a hose having a spray tip containing a plurality of orifices; and b) a water source coupled to said hose and delivering water thereto at a pressure in the range of 1,000 to 60,000 psi; and c) a frame work supporting a reel having a hub concentrically mounted to an outer housing, wherein said reel is mounted to rotate at said framework, arm means having a hollow bore for directing said hose onto said hub in stacked coils, and means for rotating said reel means and said hose as said hose is directed to and from said reel means, whereby said hose and spray tip are rotated as they extend and retract along a bore of said tube to clean said residue.

15. Apparatus as set forth in claim 14 wherein said hub exhibits a frustum shape and including a manifold mounted concentric to said hose and coupled to a water source and having a plurality of outlets for directing spray to cleaning the external surface of said hose.

16. Apparatus for cleaning residue, comprising:

a) a hose having a spray tip containing a plurality of orifices;

b) a water source coupled to said hose capable of delivering water to said hose at a pressure in the range of 1,000 to 60,000 psi;

c) a framework supporting i) transport means for extending and retracting said hose with a reciprocating motion, ii) reel means for collecting and distributing said hose along a longitudinal drive axis common to each of said transport and reel means and including a hollow arm that extends at an acute angle relative to said longitudinal axis and though which arm said hose extends and is directed to and from a tapered surface of a hub mounted concentric to said longitudinal drive axis such that said hose is stacked in a plurality of coils aligned one on top of the other and concentric to said drive axis iii) means for simultaneously rotating said transport means and said reel means, whereby said hose and spray tip are rotated as they extend and retract along a bore of said tube to clean said residue.

17. Apparatus as set forth in claim 16 including a manifold mounted to rotate concentric to said longitudinal drive axis and coupled to a water source and having a plurality of outlets for directing spray to cleaning the external surface of said hose.

18. Apparatus as set forth in claim 16 wherein a motor, drive belt and a plurality of pulleys determine the speed of rotation of each of said transport and said reel means.

19. Apparatus as set forth in claim 16 wherein said transport means includes a plurality of pinch rollers mounted to contact said hose, means for controlling the contact force of said rollers with said hose and air controlled means for directing the reciprocating axial movement of said hose in synchrony with the rotational movement of said hose.

20. Apparatus for cleaning residue, comprising:

a) a hose having a spray tip containing a plurality of orifices;

b) a water source coupled to said hose capable of delivering water to said hose at a pressure in the range of 1,000 to 60,000 psi; and c) a framework supporting i) transport means for extending and retracting said hose with a reciprocating motion and including a plurality of pinch rollers mounted to contact said hose, means for controlling the contact force of said rollers with said hose and air controlled means for directing the reciprocating axial movement of said hose, ii) reel means for collecting and distributing said hose along a longitudinal drive axis common to each of said transport and reel means and including a hollow arm that extends at an acute angle relative to said longitudinal drive axis and though which arm said hose extends and is directed to and from a tapered surface of a hub mounted concentric to said longitudinal drive axis such that said hose is stacked in a plurality of coils aligned one on top of the other and concentric to said drive axis, iii) means for simultaneously rotating said transport means and said reel means in synchrony with the rotational movement of said hose, and iv) a manifold mounted to said framework to rotate concentric to said longitudinal drive axis and coupled to a water source and having a plurality of outlets for directing spray to clean the external surface of said hose, whereby said hose and spray tip are rotated as they extend and retract along a bore of said tube to clean said residue.

* * * * *

UNITED STATES PATENT AND TRADEMARK OFFICE

CERTIFICATE OF CORRECTION

PATENT NO. : 6,626,195 B1 
DATED : September 30, 2003
INVENTOR(S) : Daniel T. Garman and Eugene R. Valentine It is certified that error appears in the above-identified patent and that said Letters Patent is hereby corrected as shown below:

Column 7,
Line 9, after “residue”, insert -- containing tubes --

Column 8,
Line 4, “residu” should read -- residue containing tubes --
Lines 24 and 59, after “residue”, insert -- containing tubes --

Signed and Sealed this

Twentieth Day of January, 2004

JON W. DUDAS
*Acting Director of the United States Patent and Trademark Office*